US005727339A

United States Patent [19]

Owen

[11] Patent Number: 5,727,339

[45] Date of Patent: Mar. 17, 1998

[54] SKI BOOT AUXILIARY SHIELD

[76] Inventor: David B. Owen, 11513 River Dr. E., Carmel, Ind. 46033

[21] Appl. No.: 782,906

[22] Filed: Jan. 11, 1997

[51] Int. Cl.[6] ..... A43B 5/18

[52] U.S. Cl. ..... 36/132; 36/7.3; 36/7.6

[58] Field of Search ..... 36/132, 7.3, 7.5, 36/7.6, 122, 123, 124, 117.3, 135, 62

[56] References Cited

U.S. PATENT DOCUMENTS

| | | | |
|---|---|---|---|
| 1,350,197 | 8/1920 | Wood | 36/7.6 X |
| 3,214,850 | 11/1965 | McNair | 36/7.6 X |
| 3,965,586 | 6/1976 | Roosli | 36/7.3 |
| 4,156,316 | 5/1979 | DeFever | 36/132 |
| 4,258,483 | 3/1981 | Hogue | 36/135 |
| 4,299,037 | 11/1981 | Carey | 36/7.6 |
| 4,542,599 | 9/1985 | Annovi | 36/132 X |
| 4,570,363 | 2/1986 | Annovi | 36/132 X |
| 4,811,504 | 3/1989 | Bunke | 36/132 |
| 5,463,823 | 11/1995 | Bell et al. | 36/7.6 X |
| 5,533,277 | 7/1996 | Bell et al. | 36/7.6 |

*Primary Examiner*—Ted Kavanaugh

[57] ABSTRACT

An accessory ski boot protection device which is easily and quickly installed onto the ski boot when needed to walk on surfaces which may damage the soles of the boot, which need to be kept in good condition being that they are a critical component of the total ski binding system. And when the skier easily and quickly removes the ski protection device from the ski boot, and as he or she prepares to re-enter the bindings, he or she may quickly and easily attach the ski protection device on the ski pant leg exterior, one device on one pant leg, and the other device on the other pant leg. Also, features such as walking traction and walking comfort are provided as well as other features which are advantageous over the prior art.

10 Claims, 4 Drawing Sheets

SKI BOOT AUXILIARY SHIELD

I. BACKGROUND—FIELD OF INVENTION

This invention relates to ski boots, more particularly to an accessory device, intended to be sold as a pair, which connects to the Downhill ski boot to protect the soles from deterioration caused by walking, the device overcoming the disadvantages of present sole-shielding devices.

II. BACKGROUND—DESCRIPTION OF PRIOR ART

In a book entitled "The Complete Skier, A practical guide for skiers of all levels", by Karen & Michael Liebreich, 1993, BBC Books, a division of BBC Enterprises Limited, Woodlands, 80 Wood Lane, London W12 OTT, it is noted in Chapter 1, The History of Skiing, that skis were first used over 4000 years ago, in prehistoric times, to enable man to continue his hunter-gatherer existence throughout the winter.

Other ski history references are noted, among them: 1713: First recorded use of baskets (the ring near the bottom of the pole which keeps the tip of the pole from sinking into the snow) on ski poles. 1840's and 50's: Skiing introduced into Australia and the United States by Norwegian and Swedish gold miners. 1930: First use of steel edges by Rudolph Lettner of Salzburg. His grip on the snow was immeasurably enhanced. 1932: First drag lift built by Gerhard Mueller of Switzerland, using a rope and a motorbike engine. In the States, Jim Curran invented the chair lift. 1948: First experiments with artificial snowmaking carried out in Connecticut. 1950: Howard Head, an aerospace engineer, produced a successful wood/plastic/aluminum laminated ski which improved turning ability. 1950's: Stretch pants invented by the German Bogner family. First safety bindings produced by Hannes Marker. 1955: Clips began to replace laces as fastenings on ski boots. 1967: First plastic boot produced by Bob Lange. 1970's: First use of fiberglass in ski construction by Austrian Franz Kneissl. The 1980's and 1990's: New materials, such as carbon fiber, titanium and Kevlar continued to improve ski equipment, while new fabrics and insulating materials improved ski clothing, offering skiers increased comfort and freedom.

The sport of Downhill skiing, sometimes referred to as Alpine skiing, involves a basic array of equipment and accessories.

Interfacing with the skier firstly is the socks and boots. For recreational skiing, an extra long pair of athletic socks does a fine job and can be bought at a discount store.

There are a wide variety of ski boots for different skill levels, but the shape and design of the soles are all basically the same in the modern ski boot. In the front of the boot and in the rear of the boot is a sole pad flange of a critical size and shape. The front and rear sole pad flange will be used to interface with the sole pad slots in the ski bindings which are also of a critical size and shape.

There is also a wide variety of skis for different uses and skill levels, but they all share the same basic platform which the ski bindings will be screwed onto. Any ski has a Tip and a Tail, a Top surface, a Base, Edges, a Waist (the narrowest point of the ski) and a Shovel (the widest point near the tip). The platform which the ski bindings will be screwed onto is called the Binding zone or the Binding position.

Viewing from the side of the ski, the ski is slightly arched and the amount of the arch is called the Camber. Viewing from the top of the ski, the ski is bowed inward to the midsection resulting in the above-mentioned Waist. The amount of bowing-inward in comparison to the Shovel and Tail is called the Sidecut.

Ski design is currently being revolutionized by the introduction of an exaggerated sidecut, sometimes referred to as a super-sidecut, which seems to be resulting in a much more controllable ski for a majority of applications.

In terms of safety, the bindings are the most important piece of ski equipment. They need to hold the foot firmly to the ski, and yet be sensitive enough to release in a fall of a given predicted force. They are well designed, complex pieces of machinery, and need to be set correctly for maximum security. A premature binding release can be as dangerous as a binding that doesn't open. The modern ski binding consists of three parts, the Heel-piece, the Toe-piece and the Brakes. The Heel-piece releases upwards, opening in a forward fall, and the Toe-piece allows sideways release in the event of a twisting fall. The brakes will automatically dig into the snow if the bindings release, preventing the ski from escaping very far.

As stated above, on the boot there is a front and rear sole pad flange which will be used to interface with the sole pad slots in the ski bindings.

The ski boots have a precision fit between their soles and the bindings. Consequently, the boots must be compatable and the bindings must be installed onto the skis by a certified ski mechanic, who needs the boots to adjust the bindings and to know where to screw the bindings to the ski.

An example of a Downhill ski boot is a Nordica AFX 46/L boot, especially designed for beginners. It is noted in the instructions as "combining comfort and lightweight characteristics with proper skiing stance for acquiring the skiing technique easily". The instructions are written in Italian, English, French, German, Spanish, and Japanese. Nordica Spa, Via Montebelluna, 5/7-31040 Trevignano (TV)-Italia (Nordica, 139 Harvest Lane, Williston, Vt., 05495).

An example of a type of binding which matches well with the above-mentioned boot is a Tyrolia 650 binding. Several references to boot soles and related safety issues are mentioned in the instructions for the Tyrolia 650 binding such as:

"Bindings should be mounted, adjusted and maintained only by certified mechanics in accordance with the manufacturer's specifications (see the Technical Handbook). Improper settings or maintenance may increase the risk of injury. Have your system (skis, boots and bindings) checked and measured by a certified Tyrolia ski mechanic at least before skiing season." and "The binding function may be ineffective when using worn out boots or boots other than those to which the bindings were adjusted. Have a certified Tyrolia ski mechanic make any necessary readjustments." The instructions are written in English, German, French, Italian, Swedish, and Japanese.

Ski poles consist of a shaft, a handle, and a basket, the handle usually having a strap which may be optionally used to secure the ski pole to the wrist.

The minimum of clothing consists of jeans which have been cut short at the ends of the legs to prevent binding up in the boot, ski trousers to go over the jeans, jacket, hat, gloves, and goggles or sunglasses.

Typically, the skier avoids walking in the ski boots, partly because it is awkward, and partly because the skier is usually aware that excessive wear of the boot sole can cause malfunctions of the boot binding. Also the skier is usually aware that dirt and gravel can stick to the sole and degrade the needed precision interface between the boot and bindings.

But it still may be necessary to walk short distances in the ski boot, i.e., between the hotel room and the lift base, or between the slope base and the restaurant, etc.

Less frequent, but more acute of a problem, is losing one or more skis on the mountain or having both skis stolen somewhere up the mountain, in which case it may become necessary to walk many miles on a catwalk back to the base of the mountain. A catwalk is a service trail of a very moderate grade for ski grooming equipment to traverse on.

Herewith conveyed that it is advantageous to keep the soles of the ski boot in good physical condition, little more foregoing references will be made to the ski equipment other than the ski boot and sole protector.

Attempts have been made to allow the skier to walk in the ski boot and to concurrently protect the soles of the boot.

The Cat Tracks™ Slip-On Walking Sole is the most commonly used device to protect the ski boot while walking. This product, noted as having U.S. Pat. No. 4,299,037, is made by Seirus Innovative Accessories™, 9076 Carroll Way, San Diego, Calif., 92121, (619) 271-9797.

The Cat Tracks™ are sold in 3 sizes, noted as: Jr-Fits Junior Sizes 4–7, Sm-Fits Adult Sizes 8 & Under, & Lg-Fits Adult Sizes 8 & Up.

In the U.S. Pat. No. 4,299,037, BOOT APPLIANCE FOR IMPROVED TRACTION AND WEAR PROTECTION, Inventor: Michael J. Carey, Nov. 10, 1981, it is noted in Col. 1, Lines 39 thru 46, that prior art devices that cover the shoe similar to an overshoe are difficult and cumbersome to put on due to the tightness of the fit of these devices.

The present inventor agrees with the analysis as stated in the preceeding paragraph, but the present inventor submits that the Carey BOOT APPLIANCE invention also shares much of the same difficulty of attachment to the boot.

On the Cat Tracks™ box it states that it "packs neatly into pocket, pack, Fanny Flasque or under snow cuff on ski pants". It also states on the box that the "Cat Tracks™ walking soles prevent boot-binding malfunctions caused by wear and dirt/gravel contamination of boot sole."

The present inventor agrees with the above paragraph, but there exists an ancillary problem that the dirt and gravel which may be clinging to the Cat Tracks™ may contaminate the ski jacket pocket, pack, etc., without the use of an extra pouch or Ziplok® bag, which the skier may not necessarily always possess.

The Carey BOOT APPLIANCE invention builds upon the principle of U.S. Pat. No. 3,965,586, SKI BOOT COVER, Inventor: Friedrich Roosli, Jun. 29, 1976. This ski boot cover is similar to the Carey device, but the Carey device seems to have enough added features to lend it a new basic nature, i.e., a traction surface, enhanced elasticity, and a front and rear notch for the front and rear sole pad flanges of the boot.

Other prior art boot and shoe protectors fail to achieve a satisfactory level of ease of use if adapted to a Downhill ski boot.

In U.S. Pat. No. 5,257,469, SHOE PROTECTOR AND METHOD OF USING THE SAME, Inventor: Zachary P. Beasley, Nov. 2, 1993, the device is designed to protect the rear of the shoe only, for use when driving a vehicle and putting the shoe at risk of being scuffed by the floorboard.

In U.S. Pat. No. 5,056,240, OVERSHOES FOR PROTECTING CLEAN FLOORS FROM SOILED SHOES OR BOOTS, Inventor: William T. Sherrill, Oct. 15, 1991, the device could be adaptable to a ski boot, but it lacks two critical features: satisfactory elasticity and positive attachment to the front and rear flanges of the ski boot.

In U.S. Pat. No. 4,780,970, SHOE PROTECTOR, Inventors: McArthur, St. et al., Nov. 1, 1988, the device is designed to protect the toe of the shoe only, for use by carpet installers whose shoe toes are subject to abrasion.

The following U.S. Patents build upon the principle of a simple overshoe and all share the same problem that, if adapted to a ski boot, they would be extremely cumbersome to put on and take off of the ski boot:

U.S. Pat. No. 4,489,510 FRICTION SOLED SHOE SLIPPER

U.S. Pat. No. 4,489,509 OVERSHOE

U.S. Pat. No. 3,643,352 OVERSHOE FOR GOLF

U.S. Pat. No. 3,313,047 SPIKED SHOE COVER

The manner in which mountain climbing crampons are installed onto a boot seem to disqualify them for use with a ski boot in that it is somewhat of a tedious process to put them on and take them off.

In U.S. Pat. No. 4,005,533, INSTEP CRAMPONS, Inventors: Anderson et al., Feb. 1, 1977, the device is designed to provide traction for boots or shoes for walking on ice or crusted snow, but it too shares a large portion of the inconvenient installation factor of traditional crampons.

In U.S. Pat. No. 3,609,888, BOWLING OVERSHOE, Inventor: Jimmy G. Rickman, Oct. 5, 1971, the device could be adaptable to a ski boot, but it lacks satisfactory elasticity. The preceeding patent, U.S. Pat. No. 3,609,887, SKI BOOT CONSTRUCTION, shows the ski boot in cross-section with its front and rear flanges, which are a feature of all modern Downhill ski boots.

In U.S. Pat. No. 3,076,273, FOOTWEAR TRACTION ATTACHMENT, the device lacks a heel protection portion and it also lacks satisfactory elasticity.

In summary to Section "II. Background-Description of Prior Art", the prior art of ski sole protection devices, of which the Cat Tracks™ is the only significant one, and has U.S. Pat. No. 4,299,037, BOOT APPLIANCE FOR IMPROVED TRACTION AND WEAR PROTECTION, Inventor: Michael J. Carey, Nov. 10, 1981, has problems relating to:

1. The case of fit of the Cat Tracks™, although a great improvement over the prior art Roosli SKI BOOT COVER, still displays some degree of difficulty of installation.

2. The need for 3 different sizes of Cat Tracks™ is somewhat of an inconvenience.

3. The storage of the dirt and grit contaminated Cat Tracks™ inclines toward a possible contamination of the ski jacket apparel.

III. OBJECTS AND ADVANTAGES

The present invention departs from the trend of the prior art as shown by Carey, BOOT APPLIANCE and by Roosli, SKI BOOT COVER, and looks for a comprehensive set of features for protecting the soles of the ski boot, among them:

1. providing traction on slippery surfaces,
2. protecting the soles of the ski boot,
3. providing ease of installation and removal on the ski boot,
4. providing secure attachment to the ski boot once the device is installed,
5. providing a novel and cleanliness-minded storage capability exclusive of traditional jacket pockets, packs, etc., but also retaining the capability of the device to be collapsed for storage into a relatively small package,
6. providing additional cushioning for the wearer on hard surfaces,
7. providing a design which looks for the possibility to need only one or 2 sizes that fit all, instead of 3 or more, and, 8. providing for a secondary set of uses for the product on the mountain.

The present invention consists of a toe base, a heel base, a base bridge webbing permanently connecting the two, and a latch system connected to the toe base and heel base which is latched at the top of the boot. The latch system is a set of 2 nylon latchstraps with metal D-rings attached thereto.

The Shield base unit, which is the only other contiguous part other than the 2 nylon latchstraps with integrally sewn-in D-rings, is made of flexible rubber. Although it is possible have the device molded in a variety of colors, it is recommended that the device be made of a compound which has no dyes in it at all, because of the tendency of the coloration to bleed out of the rubber possibly staining various ski apparel. Having only one neutral color also helps the ski shop owner streamline his or her inventory, as does the reduction of the number of different sizes needed to fit most all ski boots.

The present invention relies on webbing construction in its base bridge and adjustability in its latching structure to provide it with the necessary elasticity and adjustability to attach it to a variety of different size ski boots. The webbing construction of the base bridge allows the device to stretch to conform with the front and rear sole flanges of the ski boot.

The latching system performs the function of securing the device to the boot without the toe restraining strap 20 of the Carey, BOOT APPLIANCE (Col. 3, L. 4 of that patent), and without the heel restraining strap 30 of the same patent (Col. 3, L. 22). The somewhat small, thin, and floppy toe and heel restraining straps of the Carey invention, although of web construction, are difficult to manipulate with the only assistance provided by the small, flat heel handles 36 (Col. 3, Line 27).

The installation of the Ski Boot Auxiliary Shield involves more of a "step-in" arrangement into the toe and heel restraining walls with the actual closing and final securing of the device done at the top of the boot so the skier doesn't have to bend down so far or attempt to do a one-footed maneuver in the field.

The present invention shares with the Carey invention the molded contour on the bottom of its base, the ability to protect the soles of the ski boot, the ability to provide secure attachment to the ski boot once the device is installed, and the ability to provide additional cushioning for the wearer on hard surfaces.

The Ski Boot Auxiliary Shield goes beyond the capabilities of the Carey invention by providing ease of installation and removal on the ski boot, providing a novel and cleanliness-minded storage capability, and also retaining the capability of the device to be collapsed for storage into a compact package, providing for a design which looks for the possibility to need only one or 2 sizes that fit all, and providing for a secondary set of uses for the product on the mountain.

As stated above, the present invention utilizes a set of 2 nylon latchstraps with metal D-rings attached thereto. The D-ring latchstraps are nearly identical to, but possibly smaller than, the types of latchstraps used to fasten auto racing and motorcycle helmets below the chin. The D-ring latching system has proved itself to be very reliable, compact, and quick and easy to use.

The Ski Boot Auxiliary Shield can be secondarily stored on the calf portion the leg of the skier's pants, preferably with the traction soles outward, one on one leg, and the other on the other leg. This prevents the dirt and grit which may be contaminating the device from having to be deposited in the ski jacket pocket, and in the fanny pack, etc.

The present invention can also be folded into a relatively compact unit for packing away in a duffel bag or suitcase, with the D-ring latchstraps serving to bind up the units separately or bind them up as a pair.

The device may be designed to need only one or 2 sizes instead of 3 as with the Cat Tracks™. This is due to the fact that more adjustability is inherent in the present invention with its webbed base portion and its latchstrap system, as opposed to a stiffer base portion and no secondary adjustability feature of the Cat Tracks™ product, other than its flange straps which have little range.

In the Ski Boot Auxiliary Shield, the webbing structure of the base bridge pulls the toe wall of the device toward the toe flange of the boot and pulls the heel wall of the device toward the heel flange of the boot. The stretching of the base is done in a generally co-planar direction in relation to the boot flanges, as with the Cat Tracks™ device.

At the same time though, the latch system pulls the base portion of the device in a resolution of forces which exerts pressure on both of the downward faces of the boot flanges and on both the toe and heel exterior walls of the boot flanges. The overall effect is a secure attachment of the device to the ski boot.

In the present invention, the toe and heel bars serve less to secure the device to the boot than to indicate that the device is indeed secured over the flanges of the ski boot after the boot "pops into" the device.

It is not wanted that the device employs a toe and heel boot flange enshrouding strap arrangement, with no inherent "pop-in" feature, as with the Cat Tracks™, because this would hinder the ease with which the ski boot is nested into the sole protector device. With the present invention, the toe and heel restraining walls are inherently a little more substantial than the required floppy "cave-in" prone toe and heel restraining straps of the Carey invention.

The latching arrangement of the Ski Boot Auxiliary Shield consists of a heel D-ring latchstrap and a toe D-ring latchstrap. The toe D-ring latchstrap and the heel D-ring latchstrap are very similar, but not exactly identical as will be detailed below. The latchstraps are rotatably attached to the front and rear (toe and heel) base portions via a toe bar and a heel bar, which are, in reality, two relatively thick flexible rubber cylinders which are integrally molded into the top portions of the toe and heel base retaining walls.

The latchstraps are threaded through the bars and then are ready for use. The inherently somewhat stiff nylon latchstraps are fit into the bar bores via a slight flexible interference fit to keep them from threading out of the bars when not in use.

There is no left or right Ski Boot Auxiliary Shield. Each of the shields will fit on either boot. However, there usually is a left and right ski which is precisely adjusted to each of the left and right ski boots for maximum performance and safety.

After the ski boot is popped in the base of the Auxiliary Shield, the installation of the latchstraps to the ski boot involves a certain sequence of events which once and quickly understood, is extremely easy.

The two halves of the rearward latchstrap are pulled around to the ski boot forefront upper surface and quickly latched via its conventional D-ring tandem set.

The heel D-ring latchstrap has 2 single D-rings sewn into its nylon strap construction at locations of:

1. one roughly halfway between the heel bar and the heel D- ring latchstrap's D-ring tandem set end, and,
2. another roughly halfway between the heel bar and the heel D-ring latchstrap's non-D-ring end.

Thus, with the rearward latchstrap system secured, the net result is 2 extra single D-rings present at the midzone of the ski boot on each side.

The toe D-ring latchstrap is identical to the heel D-ring latchstrap except that it is devoid of the extra 2 single D-rings sewn into its midzones.

The toe D-ring latchstrap is threaded through the toe bar the same way as at the real, but instead of immediately folding it over the boot, at say, the rear of the boot, its ends are first threaded through the extra D-rings dangling off each side of the boot.

Next, the toe latchstrap ends are pulled forward and upward at a 45° degree angle toward the ski boot forefront upper surface.

And, as with the rearward latchstrap, the forward latchstrap is also latched, via its D-ring tandem set, at this relatively easily accessible part of the boot. The operation is now complete.

The toe D-ring latchstrap and the heel D-ring latchstrap communicative of each other constitutes a latchstrap harness system means.

Going the other way, the Auxiliary Shield is quickly and easily removed, and the device is either bound up via its D-ring latchstraps into a compact package for putting in a pocket or the Shields are latched to the leg lowers via the D-ring latchstraps in a manner which is preferred by the skier, either with Shields windward or Shields leeward.

The latchstraps themselves can be made available as a replacement part in case the latchstraps are lost. With the Carey invention, if the thin integral toe or heel restraining straps become damaged, the entire device is rendered useless.

With the Ski Boot Auxiliary Shield's matrix of useful latching straps, and sometimes in conjunction with the base unit, the device can alternately be used on the mountain for other uses, i.e.,:

1. configured into a carry strap to carry both ski boots connected loosely together,
2. configured into a neck basket for an Avalanche Dog, and,
3. the latchstraps can be removed from the device and used as emergency splint straps.

IV. Drawing Figures

V. Reference Numerals In Drawings

Figure 1:
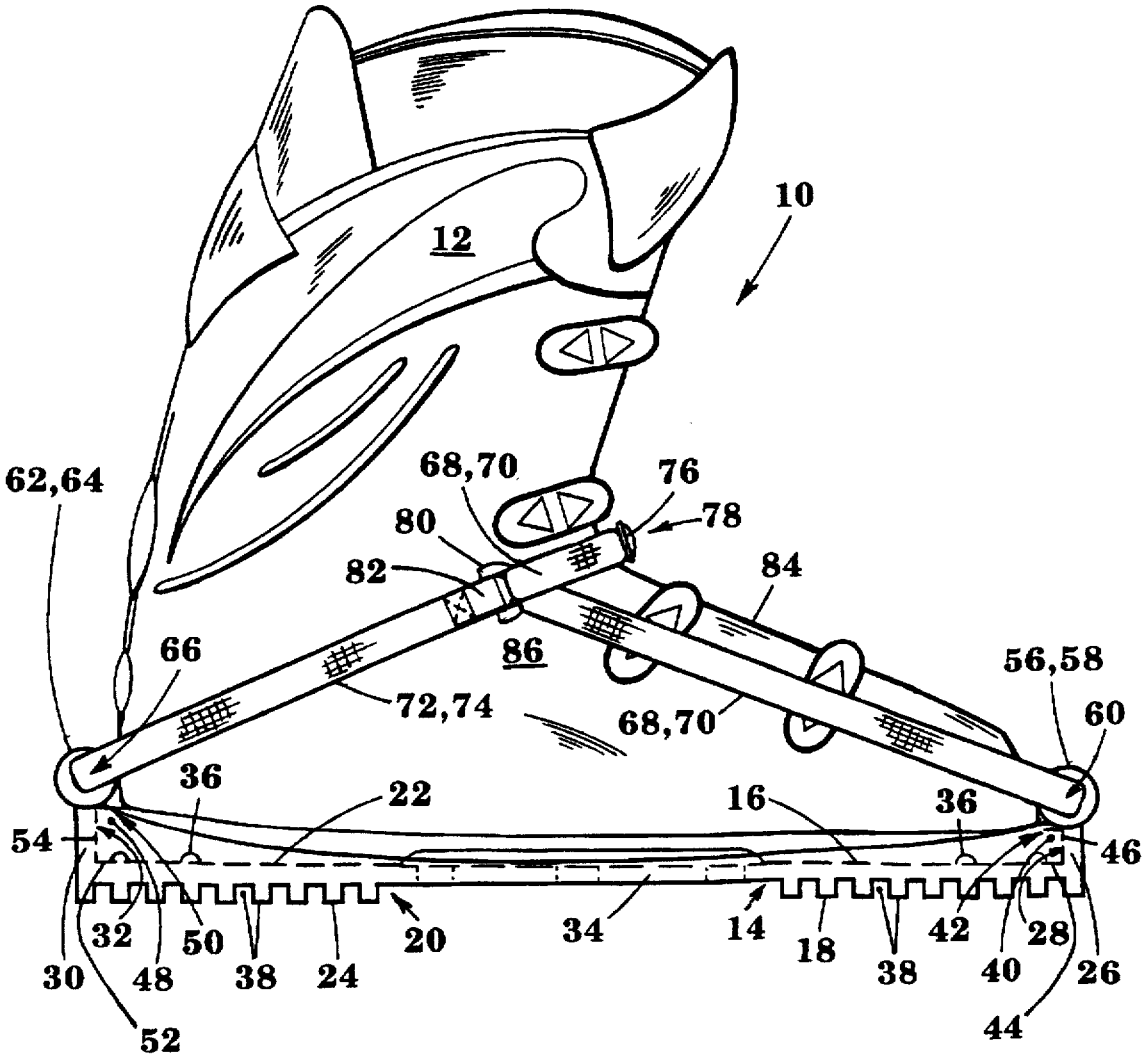
FIG. 1 is a side view of the Ski Boot Auxiliary Shield as attached to a ski boot.

10 Ski Boot Auxiliary Shield
12 ski boot
14 Shield toe base member
16 Shield toe base upward face
18 Shield toe base downward face
20 Shield heel base member
22 Shield heel base upward face
24 Shield heel base downward face
26 Shield toe retaining wall
28 Shield toe retaining wall interior face
30 Shield heel retaining wall
32 Shield heel retaining wall interior face
34 Shield base bridge webbing
36 Shield base upward traction contouring
38 Shield base downward traction contouring
40 ski boot toe flange
42 ski boot toe flange upward face
44 ski boot toe flange downward face
46 ski boot toe flange exterior face
48 ski boot heel flange
50 ski boot heel flange upward face
52 ski boot heel flange downward face
54 ski boot heel flange exterior face
56 ski boot primary toe flange retaining means
58 Shield toe bar
60 Shield toe bar bore
62 ski boot primary heel flange retaining means
64 Shield heel bar
66 Shield heel bar bore
68 ski boot secondary toe flange retaining means
70 Shield toe D-ring latchstrap
72 ski boot secondary heel flange retaining means
74 Shield heel D-ring latchstrap
76 Shield D-ring tandem set
78 Shield D-ring tandem set attachment means
80 Shield single D-ring
82 Shield single D-ring attachment means
84 ski boot forefoot upper surface
86 ski boot side regions
88 skier's pant leg
90 ski bindings
92 ski

VI. DESCRIPTION AND OPERATION—FIGS. 1 to 4

Figure 2:
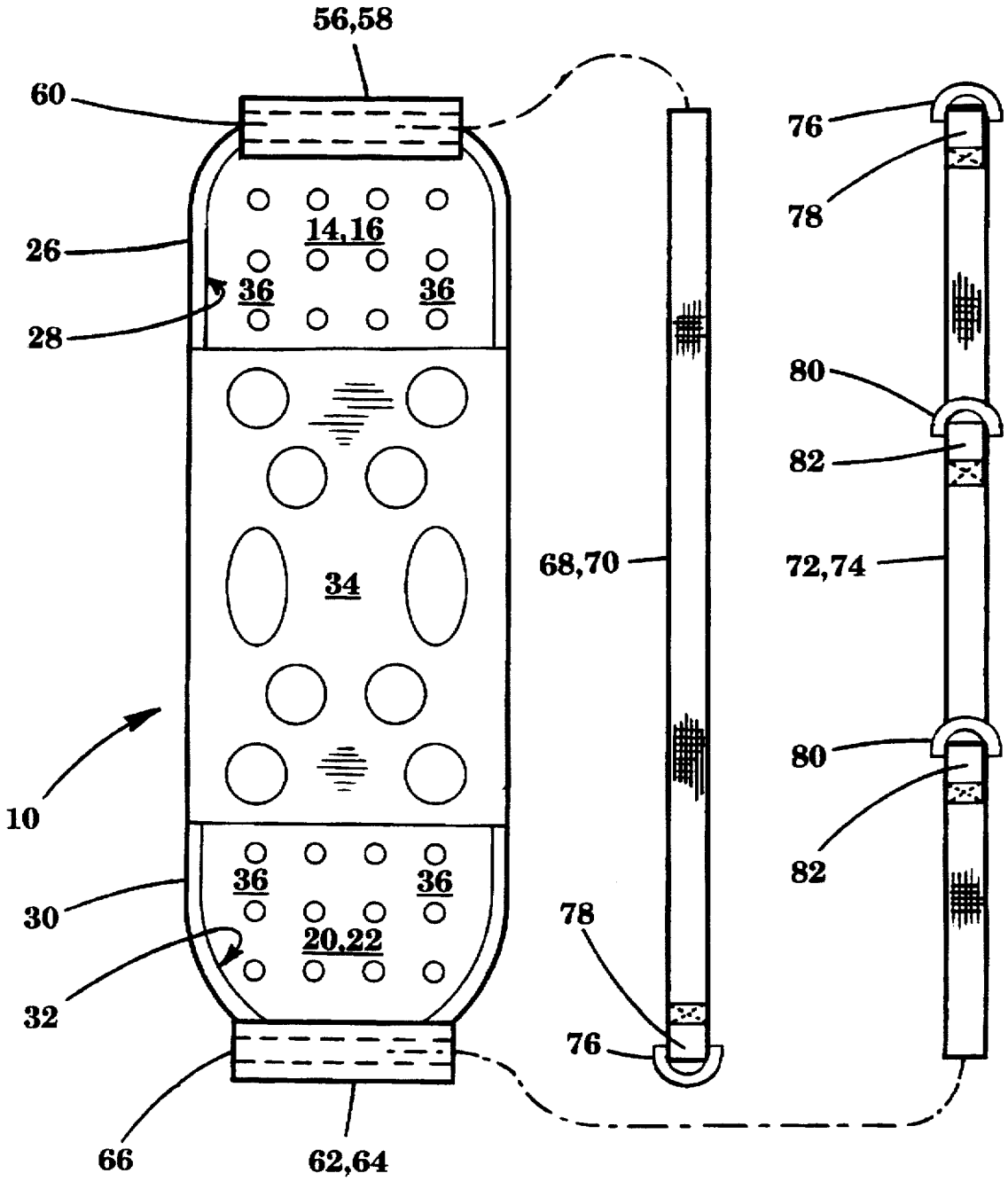
FIG. 2 is a top plan view of the present invention.
Figure 3:
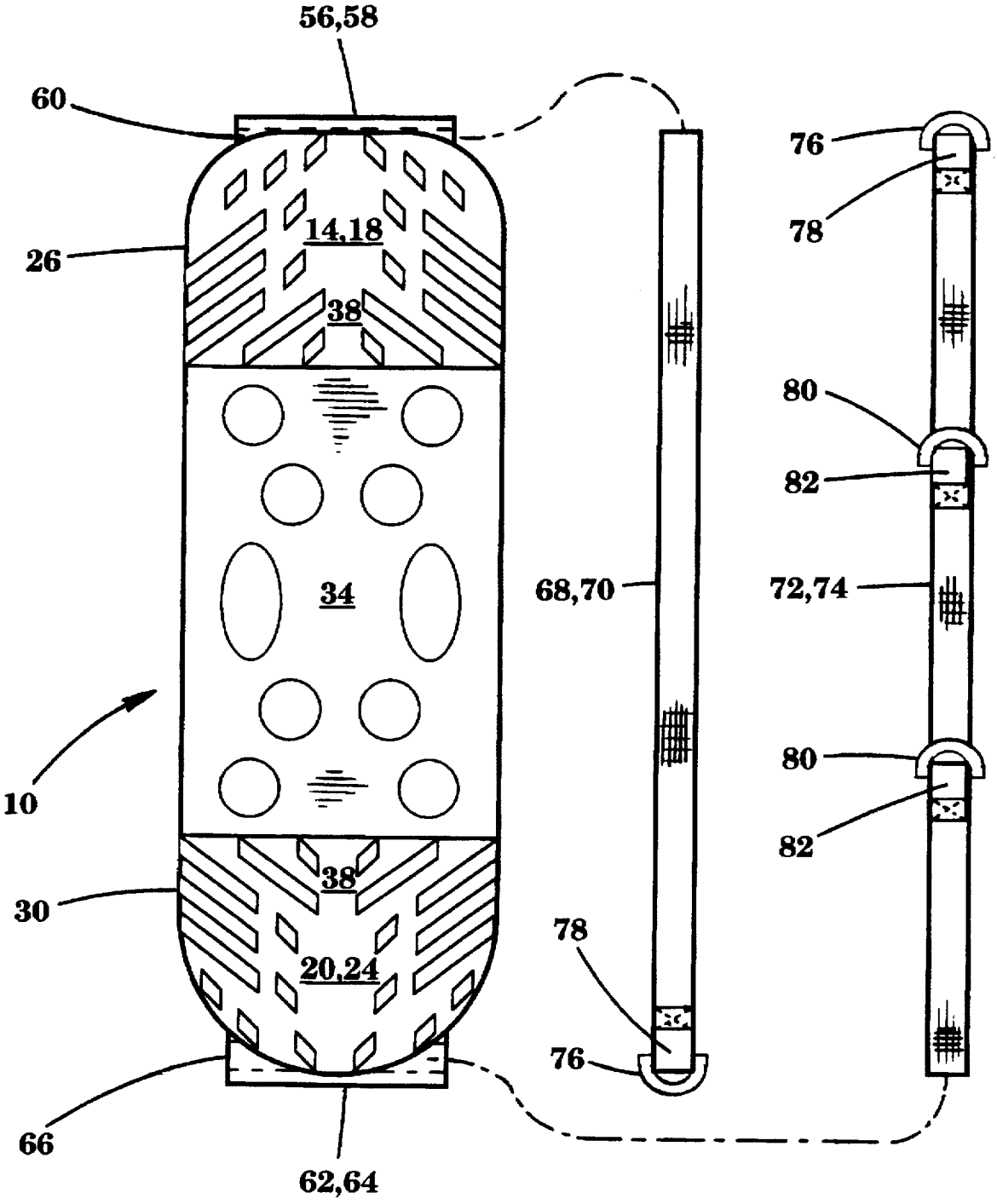
FIG. 3 is a bottom plan view thereof.

A typical embodiment of the present invention is shown in all FIGS. As shown in FIGS. 1, 2, and 3, the Ski Boot Auxiliary Shield 10 is designed to be attached to and to protect the ski boot 12.

The Shield 10 is comprised of a Shield toe base member 14, which has a Shield toe base upward face 16, and a Shield toe base downward face 18.

Also comprising Shield 10 is a Shield heel base member 20, which has a Shield heel base upward face 22, and a Shield heel base downward face 24.

Permanently molded into member 14 is a Shield toe retaining wall 26 which generally is curved to fit the form of the front of the boot 12, and which has a Shield toe retaining wall interior face 28 so abutting boot 12.

Permanently molded into member 20 is a Shield heel retaining wall 30 which generally is curved to fit the form of the rear of the boot 12, and which has a Shield heel retaining wall interior face 32 so abutting boot 12.

Also comprising Shield 10 is a Shield base bridge webbing 34 attached to members 14 and 20 which provides elastic movement respective of members 14 and Members 14 and 20 both have a Shield base upward traction contouring 36 which helps keep the boot 12 from slipping around respective of faces 16 and 22.

Members 14 and 20 also have a Shield base downward traction contouring 38 which helps keep the boot 12 from slipping around on various walking terrains (not shown).

Boot 12 has a ski boot toe flange 40, which has a ski boot toe flange upward face 42, and a ski boot toe flange downward face 44, and which also has a ski boot toe flange exterior face 46.

Boot 12 also has a ski boot heel flange 48, which has a ski boot heel flange upward face 50, and a ski boot heel flange downward face 52, and which also has a ski boot heel flange exterior face 54.

Shield 10 is provided with a ski boot primary toe flange retaining means 56 which manifests itself as a Shield toe bar When Shield 10 is installed on boot 12, bar 58 overlaps flange 40 and abuts a small portion of face 42, which helps to stabilize boot 12 nested within Shield 10.

Bar 58 is integrally molded into the upper area of the wall 26. Bar 58, slightly inward of face 28, provides a pop-in interference fit between boot 12 and the Shield 10.

Bar 58 has a Shield toe bar bore 60 which is used to mount a ski boot secondary toe flange retaining means 68.

Shield 10 is also provided with a ski boot primary heel flange retaining means 62 which manifests itself as a Shield heel bar 64. When Shield 10 is installed on boot 12, bar 64 overlaps flange 48 and abuts a small portion of face 50, which also helps to stabilize boot 12 nested within Shield 10.

Bar 64 is integrally molded into the upper area of the wall 30. Bar 64, slightly inward of face 32, provides a pop-in interference fit between boot 12 and the Shield 10.

Bar 64 has a Shield heel bar bore 66 which is used to mount a ski boot secondary heel flange retaining means 72.

Means 68 manifests itself as a Shield toe D-ring latchstrap 70.

Means 72 manifests itself as a Shield heel D-ring latchstrap 74.

Latchstrap 70 is a conventional nylon mesh strap with sewn- in D-rings serving a latching function and is constructed in such a way that it has one end which is plain or melted slightly to prevent fraying, and the other end which has a conventional D-ring tandem fastening set, in this case, a Shield D-ring tandem set 76. Latchstrap 70 with its Shield D-ring tandem set attachment means 78, manifested by one or more sewn loops of the latchstrap 70 itself, attaches set 76 thereto.

As stated above, means 72 manifests itself as a Shield heel D-ring latchstrap 74. Latchstrap 74 is also a conventional nylon mesh strap with sewn-in D-rings serving a latching function and is also constructed in such a way that it has one end which is plain or melted slightly to prevent fraying, and the other end which has a conventional D- ring tandem fastening set, in this case also, a Shield D-ring tandem set 76. Latchstrap 74 also with its Shield D-ring tandem set attachment means 78, manifested by one or more sewn loops of the latchstrap 74 itself, attaches set 76 thereto.

But latchstrap 74 is slightly different from latchstrap 70, in that it has two Shield single D-rings 80 attached thereto. At about ⅓ the way across it has a single D-ring 80 attached thereto and another, 80, at about ⅔ the way across. The Shield single D-ring attachment means 82, manifests itself by one or more sewn loops of the latchstrap 74 itself and attaches D-rings 80 thereto.

The toe latchstrap 70 is threaded through bar 58's toe bar bore 60 and pulled roughly bisected relative to bar Heel latchstrap 74 is threaded through bar 64's heel bar bore 66 and also pulled approximately symmetrical to bar 64. Bar bores 60 and 66 impart a slight interference fit onto the latchstraps 70 and 74 to prevent them from separating from the Shield 10 when not in use.

After the ski boot 12 is popped in the base members 14 and 20, the two halves of the heel latchstrap 74 are brought around he boot 12's ski boot side regions 86 and attached at the ski boot forefoot upper surface 84.

Next the toe latchstrap 70 is threaded through latchstrap 74's single D-rings 80, pulled forward and upward, and likewise attached at the ski boot forefoot upper surface 84.

It may be necessary that single D-rings 80 are slightly larger than D-ring tandem sets 76 to allow the latchstrap 70 with its D-rings 76 to thread through latchstrap 74's single D-rings 80. This completes the latching process of Shield 10 to ski boot 12.

There is an ancillary third nesting means of the ski boot 12 within Shield 10, that being the fact that toe bar 58 usually abuts with force the front region of the boot 12 upward of the toe flange 40 itself, and the heel bar 64 also usually abuts with force the rear region of the boot 12 upward of the heel flange 48 itself, as seen clearly in FIG. 1. But this third nesting factor occurs only after the primary and secondary flange retaining means are executed; nevertheless, this third nesting parameter adds to the total nesting capability of the Shield 10 communicative of boot 12.

The pair of Shields 10, after removal from the pair of ski boots 12, can be stored on the lower legs of the skier's pant legs 88 via latchstraps 70 and 74 being wrapped around the legs 88 and being attached thereto by D-ring tandem sets 76.

The manipulation of the bars 58 and 64, and thus the manipulation of the Shield 10 in general, is greatly enhanced by the existence of the latchstraps 76 and 74 which are rotatably connected to bars 58 and 64 via bars 58 and 64's bores 60 and 66 respectively.

Figure 4:
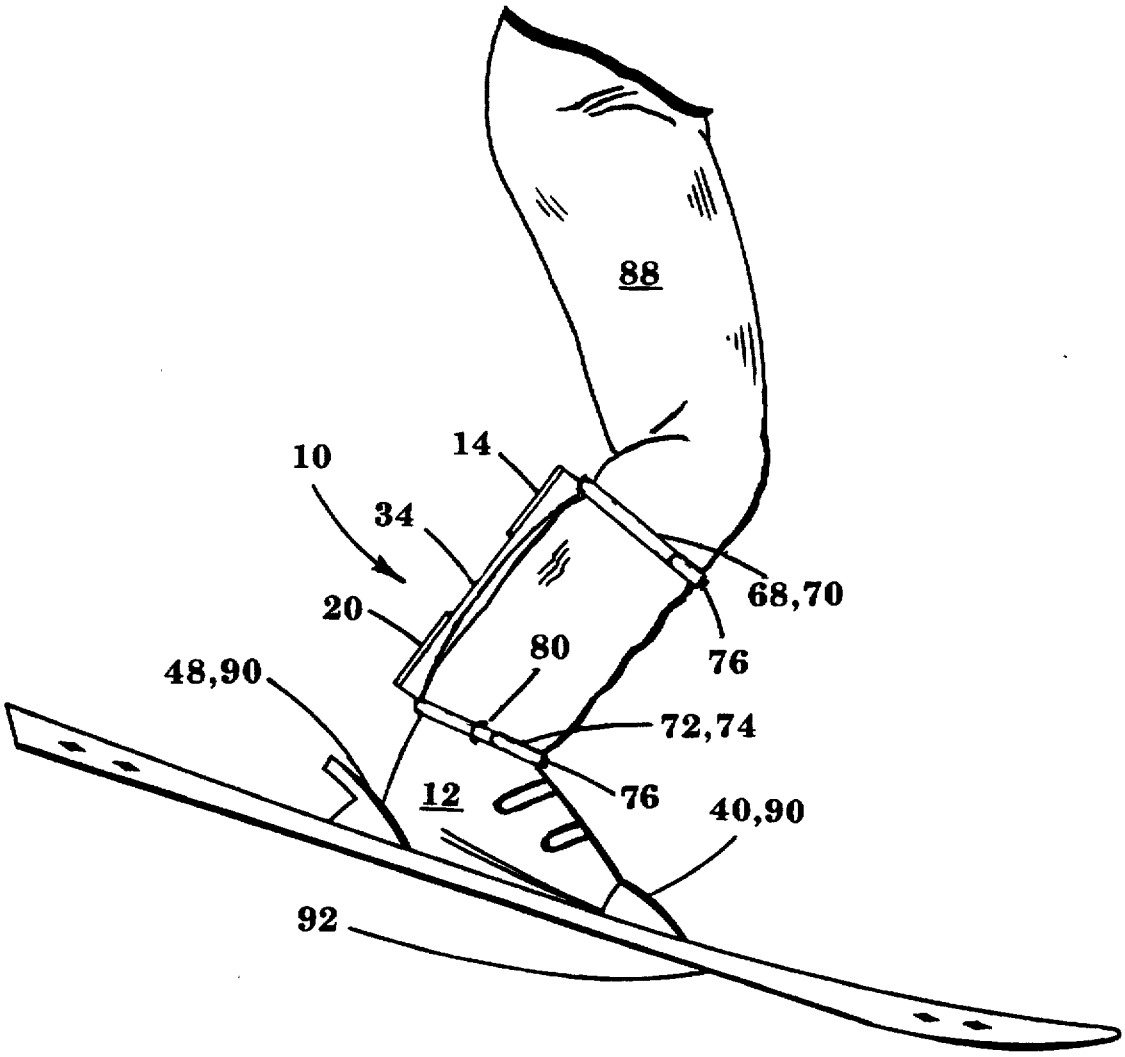
FIG. 4 is a side view of the Ski Boot Auxiliary Shield as stored on the calf portion the leg of the skier's pants with the traction soles outward.

FIG. 4 shows a Shield 10 as mounted and stored on the skier's pant leg 88, with one Shield 10 on one leg and the other Shield 10 on the other. Before latching, the latchstraps 70 and 74 are rotated substantially perpendicular to the general plane of the base members 14 and 20 of the shield 10. The pant leg 88 is shown cuffed over the ski boot 12. Boot 12 is shown releasably attached to its ski bindings 90 which are permanently attached to the ski 92.

VII. SUMMARY, RAMIFICATIONS, AND SCOPE

Accordingly, the reader will see that The Ski Boot Auxiliary Shield provides for a novel and useful sole-shielding device for Alpine ski boots, when walking on surfaces which may damage the precision toe and heel flange portions of the boot.

There are no opposing disadvantages resulting from the present invention. Maintained are the features of providing for traction on slippery surfaces, protecting the soles of the ski boot, providing additional cushioning for the wearer on hard surfaces, and providing secure attachment to the ski boot once the device is installed.

But certain features are shown in the present invention which go beyond the capability of the prior art, such as:

- providing better case of installation and removal on the ski boot,
- providing a novel and cleanliness-minded storage capability exclusive of traditional jacket pockets, packs, etc., but also retaining the capability of the device to be collapsed for storage into a relatively small package,
- providing a design which looks for the possibility to need only one or 2 sizes that fit all, instead of 3 or more, and,
- providing for a secondary set of uses for the product on the mountain.

Sole-shielding devices are very simple in nature, and such devices are quite of open or easily-observable nature.

The prior art has long had much motivation as to apparatus of the present invention, and a consideration of such prior art, and a recollection of ski boots used by the reader, or seen by the reader in a ski shop, helps to emphasize the inventive nature of this invention.

Although the description above contains many specificities, these should not be construed as limiting the scope of the invention but as merely providing illustrations of the presently preferred embodiment of this invention.

For example, the conventional D-ring tandem sets and the single D-rings could be substituted by conventional side-release latches such as are used in myriad backpack systems, fanny packs, camping equipment, etc., or by other types of latch units inclusive of the capability of quick ease of use, quick adjustability, and compactness.

Thus the scope of the invention should be determined by the appended claims and their legal equivalents, rather than by the examples given.

I claim:

1. A ski boot boot auxiliary shield comprising a toe base member, a heel base member, and a base bridge webbing, said toe base member including a toe base upward face which substantially abuts the conventional ski boot toe flange downward face, and a toe base downward face which substantially abuts a variety of walking terrains encountered by the skier walking in ski boots, said heel base member including a heel base upward face which substantially abuts the conventional ski boot heel flange downward face, and a heel base downward face which also substantially abuts a variety of walking terrains encountered by the skier thereof, said toe base member provided with a toe retaining wall including a toe retaining wall interior face which substantially abuts the conventional ski boot toe flange exterior face, said heel base member provided with a heel retaining wall including a heel retaining wall interior face which substantially abuts the conventional ski boot heel flange exterior face, said base bridge webbing comprised of a resiliently stretchable structure which is conjoined to said toe base member, and to said heel base member, thus providing said toe retaining wall interior face and said heel retaining wall interior face resilient memory force respective of one another, said toe base member upward face and said heel base upward face provided with a base upward traction contouring, and said toe base member downward face and said heel base member downward face provided with a base downward traction contouring, said toe base member provided with a ski boot primary toe flange retaining means dependent on the said toe retaining wall interior face and the said heel retaining wall interior face having said resilient memory force respective of one another, said heel base member provided with a ski boot primary heel flange retaining means also dependent on the said toe retaining wall interior face and the said heel retaining wall interior face having said resilient memory force respective of one another, said ski boot primary toe flange retaining means comprised of a toe bar and said primary heel flange retaining means comprised of a heel bar, said toe bar comprised of a protuberance which is conjoined to the upward region of said toe retaining wall, said protuberance providing a flexible interference fit onto the conventional ski boot toe flange upward face, therewith providing a ski boot nesting capability in conjunction with said toe retaining wall interior face imparting an interference fit unto said ski boot toe flange exterior face, said heel bar comprised of a protuberance which is conjoined to the upward region of said heel retaining wall, said protuberance providing a flexible interference fit onto the conventional ski boot heel flange upward face, therewith providing a ski boot nesting capability in conjunction with said heel retaining wall interior face imparting an interference fit unto said ski boot heel flange exterior face, said toe base member provided with a ski boot secondary toe flange retaining means independent of said toe retaining wall interior face and said heel retaining wall interior face having said resilient memory force respective of one another, said heel base member provided with a ski boot secondary heel flange retaining means also independent of said toe retaining wall interior face and said heel retaining wall interior face having said resilient memory force respective of one another, said ski boot secondary toe flange retaining means and said secondary heel flange retaining means comprised of a releasable latchstrap harness system means, said harness system means comprised of at least one strips of strong material with one or more latches connected thereto, configured and interconnected in such a way to provide force-applying means communicative of said auxiliary shield and said ski boot, providing for an overall effect of a secure attachment of said auxiliary shield to said ski boot.

2. The ski boot boot auxiliary shield of claim 1, wherein said latchstrap harness system means is provided with a toe D-ring latchstrap and a heel D-ring latchstrap, said toe D-ring latchstrap provided with a D-ring tandem set connected to one of its end regions, said heel D-ring latchstrap provided with a D-ring tandem set also connected to one of its end regions, but also provided with one or more single D-rings connected inward of its ends, complimentary to its body, said D-ring tandem set comprised of at least two D-shaped rings which are connected to said latchstraps with a D-ring tandem set attachment means, and which when having had said latchstrap's ends threaded through its D-ring tandem set, and when having said ends reversed in position and threaded again through a second ring of the D-ring tandem set, provides for a conventional, effective, and compact D-ring latching system for the latchstraps, said single D-rings providing for a releasable conjoining means communicative of said toe D-ring latchstrap and said heel D-ring latchstrap, thus providing said toe retaining wall interior face and said heel retaining wall interior face a secondary force respective of one another independent of said resilient memory force respective of one another provided by said base bridge webbing.

3. The ski boot boot auxiliary shield of claim 2, wherein said latchstrap harness system means with its releasability means is provided with releasable reconnecting means onto the skier's pant leg, thus providing for a means of storing said shields exclusive of interiorly of said skier's apparel, providing for a cleanliness-minded possession of said shields on the mountain without contaminating said apparel with dirt and gravel.

4. The ski boot boot auxiliary shield of claim 1, wherein said latchstrap harness system means with its releasability means is provided with releasable reconnecting means onto the skier's pant leg, thus providing for a means of storing said shields exclusive of interiorly of said skier's apparel, providing for a cleanliness-minded possession of said shields on the mountain without contaminating said apparel with dirt and gravel.

5. The ski boot boot auxiliary shield of claim 1, wherein said toe base member is provided with one or more through duct means which allow through transportation of said latchstrap harness system means and said heel base member is also provided with one or more through duct means which allow through transportation of said latchstrap means.

6. The ski boot boot auxiliary shield of claim 5, wherein said latchstrap harness system means is provided with a toe D-ring latchstrap and a heel D-ring latchstrap, said toe D-ring latchstrap provided with a D-ring tandem set connected to one of its end regions, said heel D-ring latchstrap provided with a D-ring tandem set also connected to one of its end regions, but also provided with one or more single D-rings connected inward of its ends, complimentary to its body, said D-ring tandem set comprised at least D-shaped rings which are connected to said latchstraps with a D-ring tandem set attachment means, and which when having had said latchstrap's ends threaded through its D-ring tandem set, and when having said ends reversed in position and threaded again through a second ring of the D-ring tandem set, provides for a conventional, effective, and compact D-ring latching system for the latchstraps, said single D-rings providing for a releasable conjoining means communicative of said toe D-ring latchstrap and said heel D-ring latchstrap, thus providing said toe retaining wall interior face and said heel retaining wall interior face a secondary force respective of one another independent of said resilient memory force respective of one another provided by said base bridge webbing.

7. The ski boot boot auxiliary shield of claim 5, wherein said latchstrap harness system means with its releasability means is provided with releasable reconnecting means onto the skier's pant leg, thus providing for a means of storing said shields exclusive of interiorly of said skier's apparel, providing for a cleanliness-minded possession of said shields on the mountain without contaminating said apparel with dirt and gravel.

8. The ski boot boot auxiliary shield of claim 6, wherein said latchstrap harness system means with its releasability means is provided with releasable reconnecting means onto the skier's pant leg, thus providing for a means of storing said shields exclusive of interiorly of said skier's apparel, providing for a cleanliness-minded possession of said shields on the mountain without contaminating said apparel with dirt and gravel.

9. A ski boot boot auxiliary shield comprising a toe base member, a heel base member, and a base bridge webbing, said toe base member including a toe base upward face which substantially abuts the conventional ski boot toe flange downward face, and a toe base downward face which substantially abuts a variety of walking terrains encountered by the skier walking in ski boots, said heel base member including a heel base upward face which substantially abuts the conventional ski boot heel flange downward face, and a heel base downward face which also substantially abuts a variety of walking terrains encountered by the skier thereof, said toe base member provided with a toe retaining wall including a toe retaining wall interior face which substantially abuts the conventional ski boot toe flange exterior face, said heel base member provided with a heel retaining wall including a heel retaining wall interior face which substantially abuts the conventional ski boot heel flange exterior face, said base bridge webbing comprised of a resiliently stretchable structure which is integrally molded to said toe base member, and to said heel base member, thus providing said toe retaining wall interior face and said heel retaining wall interior face resilient memory force respective of one another, said toe base member upward face and said heel base upward face provided with a base upward traction contouring, and said toe base member downward face and said heel base member downward face provided with a base downward traction contouring, said toe base member provided with a ski boot primary toe flange retaining means dependent on the said toe retaining wall interior face and the said heel retaining wall interior face having said resilient memory force respective of one another, said heel base member provided with a ski boot primary heel flange retaining means also dependent on the said toe retaining wall interior face and the said heel retaining wall interior face having said resilient memory force respective of one another, said ski boot primary toe flange retaining means comprised of a toe bar and said primary heel flange retaining means comprised of a heel bar, said toe bar comprised of a protuberance which is integrally molded to the upward region of said toe retaining wall, said protuberance providing a flexible interference fit onto the conventional ski boot toe flange upward face, therewith providing a ski boot nesting capability in conjunction with said toe retaining wall interior face imparting an interference fit unto said ski boot toe flange exterior face, said heel bar comprised of a protuberance which is integrally molded to the upward region of said heel retaining wall, said protuberance providing a flexible interference fit onto the conventional ski boot heel flange upward face, therewith providing a ski boot nesting capability in conjunction with said heel retaining wall interior face imparting an interference fit unto said ski boot heel flange exterior face, said toe base member provided with a ski boot secondary toe flange retaining means independent of said toe retaining wall interior face and said heel retaining wall interior face having said resilient memory force respective of one another, said heel base member provided with a ski boot secondary heel flange retaining means also independent of said toe retaining wall interior face and said heel retaining wall interior face having said resilient memory force respective of one another, said ski boot secondary toe flange retaining means and said secondary heel flange retaining means comprised of a latchstrap harness system means which is integrally molded to said base portions of said shield, said harness system means providing said toe retaining wall interior face and said heel retaining wall interior face a secondary force respective of one another independent of said resilient memory force respective of one another provided by said base bridge webbing, said harness system means comprised of at least one strip of the same material with which said base portions are molded of, with at least one latch connected thereto, configured and interconnected in such a way to provide force-applying means communicative of said auxiliary shield and said ski boot, providing for an overall effect of a secure attachment of said auxiliary shield to said ski boot, said latchstrap harness system means with its releasability means is provided with releasable reconnecting means onto the skier's pant leg, thus providing for a means of storing said shields exclusive of interiorly of said skier's apparel, providing for a cleanliness-minded possession of said shields on the mountain without contaminating said apparel with dirt and gravel.

10. A ski boot boot auxiliary shield comprising a toe base member, a heel base member, and a base bridge webbing, said toe base member including a toe base upward face which substantially abuts the conventional ski boot toe flange downward face, and a toe base downward face which substantially abuts a variety of walking terrains encountered by the skier walking in ski boots, said heel base member including a heel base upward face which substantially abuts the conventional ski boot heel flange downward face, and a heel base downward face which also substantially abuts a variety of walking terrains encountered by the skier thereof, said toe base member provided with a toe retaining wall including a toe retaining wall interior face which substantially abuts the conventional ski boot toe flange exterior face, said heel base member provided with a heel retaining wall including a heel retaining wall interior face which substantially abuts the conventional ski boot heel flange exterior face, said base bridge webbing comprised of a resiliently stretchable structure which is conjoined to said toe base member, and to said heel base member, thus providing said toe retaining wall interior face and said heel retaining wall interior face resilient memory force respective of one another, said toe base member upward face and said heel base upward face provided with a base upward traction contouring, and said toe base member downward face and said heel base member downward face provided with a base downward traction contouring, said toe base member provided with a ski boot primary toe flange retaining means dependent on the said toe retaining wall interior face and the said heel retaining wall interior face having said resilient memory force respective of one another, said heel base member provided with a ski boot primary heel flange retaining means also dependent on the said toe retaining wall interior face and the said heel retaining wall interior face having said resilient memory force respective of one another, said ski boot primary toe flange retaining means is comprised of a toe bar and said primary heel flange retaining means is comprised of a heel bar, said toe bar comprised of a protuberance which is conjoined to the upward region of said toe retaining wall, said protuberance providing a flexible interference fit onto the conventional ski boot toe flange upward face, therewith providing a ski boot nesting capability in conjunction with said toe retaining wall interior face imparting an interference fit unto said ski boot toe flange exterior face, said heel bar comprised of a protuberance which is conjoined to the upward region of said heel retaining wall, said protuberance providing a flexible interference fit onto the conventional ski boot heel flange upward face, therewith providing a ski boot nesting capability in conjunction with said heel retaining wall interior face imparting an interference fit unto said ski boot heel flange exterior face, said ski boot nesting capability ultimately dependent on the said toe retaining wall interior face and the said heel retaining wall interior face having said resilient memory force respective of one another, said toe base member provided with a ski boot secondary toe flange retaining means independent of said toe retaining wall interior face and said heel retaining wall interior face having said resilient memory force respective of one another, said heel base member provided with a ski boot secondary heel flange retaining means also independent of said toe retaining wall interior face and said heel retaining wall interior face having said resilient memory force respective of one another, said ski boot secondary toe flange retaining means and said secondary heel flange retaining means is comprised of a releasable latchstrap harness system means, said harness system means providing said toe retaining wall interior face and said heel retaining wall interior face a secondary force respective of one another independent of said resilient memory force respective of one another provided by said base bridge webbing, said toe base member is provided with at least one through duct means which allow through transportation of said latchstrap harness system means and said heel base member is also provided with at least one through duct means which allow through transportation of said latchstrap means, said latchstrap harness system means is provided with a toe D-ring latchstrap and a heel D-ring latchstrap, said toe D-ring latchstrap provided with a D-ring tandem set connected to one of its end regions, said heel D-ring latchstrap provided with a D-ring tandem set also connected to one of its end regions, but also provided with one or more single D-rings connected inward of its ends, complimentary to its body, said D-ring tandem set comprising at least D-shaped rings which are connected to said latchstraps with a D-ring tandem set attachment means, and which when having had said latchstrap's ends threaded through its D-ring tandem set, and when having said ends reversed in position and threaded again through a second ring of the D-ring tandem set, provides for a conventional, effective, and compact D-ring latching system for the latchstraps, said single D-rings providing for a releasable conjoining means communicative of said toe D-ring latchstrap and said heel D-ring latchstrap, thus providing said toe retaining wall interior face and said heel retaining wall interior face a secondary force respective of one another independent of said resilient memory force respective of one another provided by said base bridge webbing, said latchstrap harness system means with its releasability means is provided with releasable reconnecting means onto the skier's pant leg, thus providing for a means of storing said shields exclusive of interiorly of said skier's apparel, said releasable reconnecting means provided by said toe D-ring latchstrap and said heel D-ring latchstrap, with their said D-ring tandem sets connected to their said end regions, thus providing for said means of storing said shields and providing for a cleanliness-minded possession of said shields on the mountain without contaminating said apparel with dirt and gravel.

* * * * *

UNITED STATES PATENT AND TRADEMARK OFFICE

CERTIFICATE OF CORRECTION

Patent No.: 5,727,339

Dated: March 17, 1998

Inventor: David B. Owen

It is certified that error appears in the above-indentified patent and that said Letters Patent is hereby corrected as shown below:

Column 3, Line 67,
change 'St.' to---Sr.---

Column 4, Line 38,
change 'case' to---ease---

Column 8, Line 54,
change '14 and' to---14 and 20.---

Column 9, Line 4,
change 'bar' to---bar 58.---

Column 9, Line 54,
change 'bar' to---bar 58.---

Column 10, Line 23,
change '76' to---70---

Column 11, Line 1,
change the first paragraph of Column 11 to be indented the same as the rest of the specification.

Column 11, Line 15,
change 'boot boot' to---boot---

UNITED STATES PATENT AND TRADEMARK OFFICE

CERTIFICATE OF CORRECTION

Patent No.: 5,727,339

Dated: March 17, 1998

Inventor: David B. Owen

It is certified that error appears in the above-indentified patent and that said Letters Patent is hereby corrected as shown below:

Column 12, Line 18,
change 'strips' to---strip---

Column 12, Line 26,
change 'boot boot' to---boot---

Column 12, Line 52,
change 'boot boot' to---boot---

Column 12, Line 60,
change 'boot boot' to---boot---

Column 13, Line 1,
change 'boot boot' to---boot---

Column 13, Line 7,
change 'boot boot' to---boot---

Column 13, Line 16,
change 'at least' to---of at least two---

Column 13, Line 33,
change 'boot boot' to---boot---

Column 13, Line 41,
change 'boot boot' to---boot---

Column 13, Line 49,
change 'boot boot' to---boot---

UNITED STATES PATENT AND TRADEMARK OFFICE

CERTIFICATE OF CORRECTION

PATENT NO. : Patent No.: 5,727,339

DATED : Dated: March 17, 1998

INVENTOR(S) : Inventor: David B. Owen

It is certified that error appears in the above-indentified patent and that said Letters Patent is hereby corrected as shown below:

Column 15, Line 6,
change 'boot boot' to---boot---

Column 16, Line 36,
change 'least D-shaped' to---least two D-shaped---

Signed and Sealed this

Seventh Day of July, 1998

Bruce Lehman

*Attest:*

BRUCE LEHMAN

*Attesting Officer*

*Commissioner of Patents and Trademarks*